US008675904B2

(12) United States Patent
Fukuma

(10) Patent No.: US 8,675,904 B2
(45) Date of Patent: Mar. 18, 2014

(54) HEADPHONE DEVICE

(75) Inventor: Yohei Fukuma, Chiba (JP)

(73) Assignee: Sony Corporation, Tokyo (JP)

( * ) Notice: Subject to any disclaimer, the term of this patent is extended or adjusted under 35 U.S.C. 154(b) by 359 days.

(21) Appl. No.: 12/821,415

(22) Filed: Jun. 23, 2010

(65) Prior Publication Data

US 2011/0002497 A1 Jan. 6, 2011

(30) Foreign Application Priority Data

Jul. 2, 2009 (JP) ..... 2009-158154

(51) Int. Cl.
*H04R 25/00* (2006.01)

(52) U.S. Cl.
USPC ..... 381/374

(58) Field of Classification Search
USPC ..... 381/374; D14/205
See application file for complete search history.

(56) References Cited

U.S. PATENT DOCUMENTS

| | | | | | |
|---|---|---|---|---|---|
| 2,796,747 | A * | 6/1957 | Ebert | 63/19 |
| 4,409,442 | A * | 10/1983 | Kamimura | 381/383 |
| 4,597,469 | A * | 7/1986 | Nagashima | 181/129 |
| 4,609,786 | A * | 9/1986 | Omoto et al. | 381/383 |
| 5,341,634 | A * | 8/1994 | Straight | 59/80 |
| 6,016,574 | A * | 1/2000 | Chen | 2/209 |
| 6,449,806 | B1 * | 9/2002 | Engelhard et al. | 24/3.1 |
| 7,940,947 | B2 * | 5/2011 | Kaulfuss et al. | 381/374 |

FOREIGN PATENT DOCUMENTS

| | | |
|---|---|---|
| JP | 03-239095 | 10/1991 |
| JP | 2001-333483 A | 11/2001 |
| JP | 2003-274477 A | 9/2003 |

* cited by examiner

*Primary Examiner* — Jianchun Qin
(74) *Attorney, Agent, or Firm* — Sony Corporation

(57) ABSTRACT

A headphone device is provided which includes a housing including a speaker unit, and a band formed of a series of links and connected to the housings at an end of the band, each link being connected to one another by a joint. The each link includes an angle limiter for limiting a rotation angle between the each link and an adjacent link to the each link, and the band has an elastic force in a direction in which the housing presses an auricle by limiting the rotation angle.

9 Claims, 17 Drawing Sheets

HEADPHONE DEVICE

BACKGROUND OF THE INVENTION

1. Field of the Invention

The present invention relates to a headphone device.

2. Description of the Related Art

Headphones include housings in which speaker units for outputting reproduced sound are mounted and a band connected to the housings.

Housings are categorized into earmuff type, on-ear type, intra-concha type, insert type, and the like depending on the size and the positional relationship between the housing and a human auricle. The earmuff type has a shape covering an entire auricle, and the on-ear type is smaller than the earmuff type and has a shape in contact with the surface of auricle. The intra-concha type is inserted into a cavum conchae of an auricle and has a shape supported by a tragus and an antitragus, and the insert type is inserted into an ear canal and has a shape worn like earplugs. An ear-hanging type earphone is disclosed in Japanese Patent Application Laid-Open No. 2001-333483.

In particular, the earmuff type headphones and the on-ear type headphones hold the housings by, for example, a belt-like band connected to the housings so that the housings are arranged in good balance. The bands are categorized into a neckband, a headband, and the like depending on the positional relationship between the band and a head. The neckband is a band placed along the back of the head, and the headband is a band placed across the top of the head. An example of the neckband is disclosed in Japanese Patent Application Laid-Open No. 2003-274477.

SUMMARY OF THE INVENTION

Bands in related art include complex components, and generally, shapes of the components are different from one another. A part of the components included in the band is difficult to be removed, and a complex mechanism is used in the band to adjust the length of the band. Furthermore, many bands have a shape which is difficult to easily bend in a direction (inward direction) in which the housings press auricles.

In light of the foregoing, it is desirable to provide novel and improved headphones whose band can be manufactured with simple components and easily rolled up.

According to an embodiment of the present invention, there is provided a headphone device including a housing including a speaker unit, and a band formed of a series of links and connected to the housings at an end of the band, each link being connected to one another by a joint. The each link includes an angle limiter for limiting a rotation angle between the each link and an adjacent link to the each link, and the band has an elastic force in a direction in which the housing presses an auricle by limiting the rotation angle.

The limited rotation angle for a portion of the band nearby a connection to the housing may be different from the limited rotation angle for a portion in a middle of the band.

The band can be helically rolled up.

The band may be formed of an elastic material.

The each link can be attached to or detached from one another.

The link may have a linear opening. An electrical wire for transmitting an electrical signal from or to the speaker unit can be inserted into an inside of the band through the opening, or the electrical wire can be removed from the inside to an outside of the band through the opening.

According to an embodiment of the present invention, the band can be manufactured with simple components and the band can be easily rolled up.

DETAILED DESCRIPTION OF THE EMBODIMENTS

Figure 1:
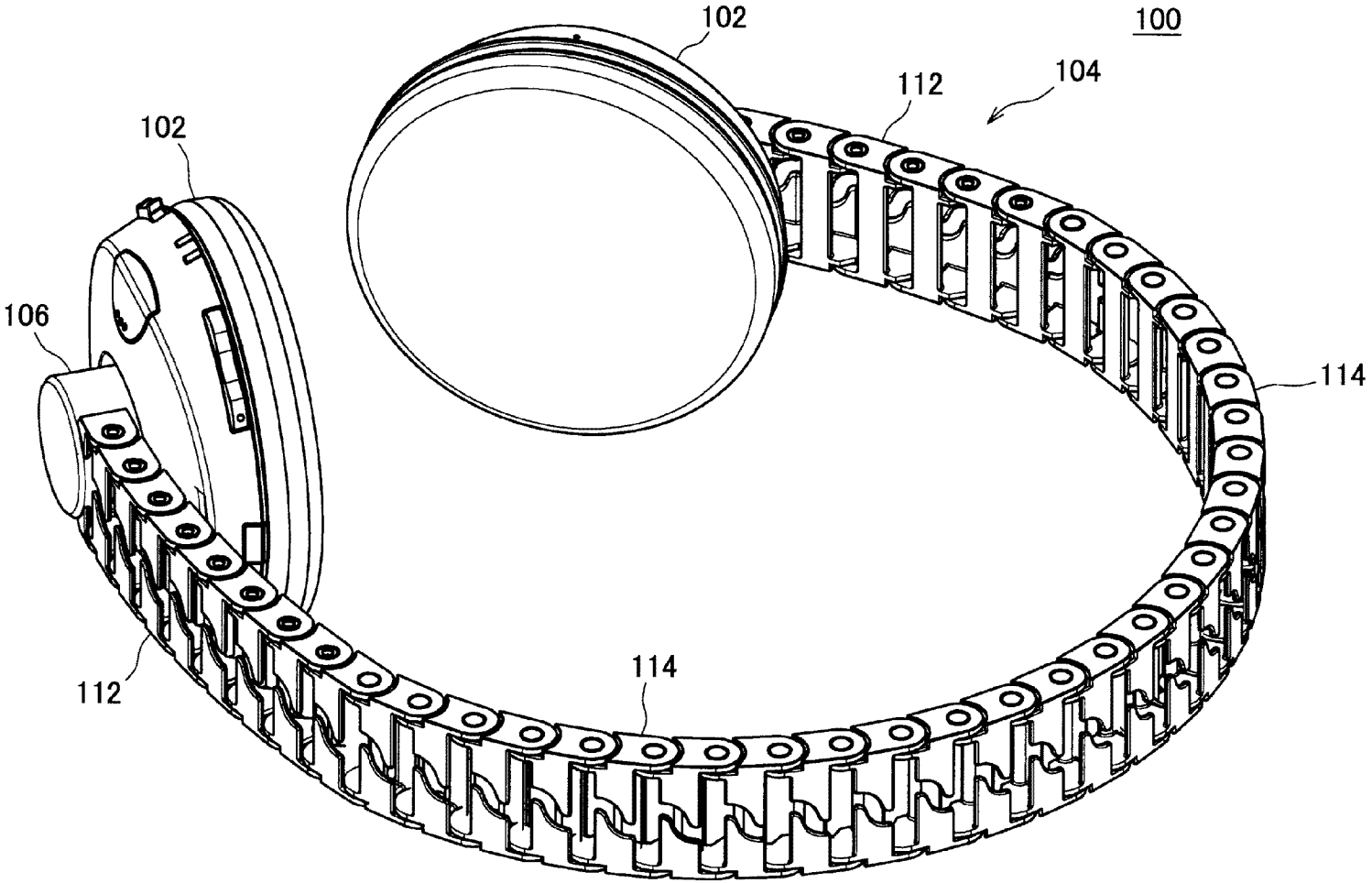
FIG. 1 is a perspective view showing headphones 100 according to a first embodiment of the present invention.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

The description will be made in the following order.

1. First Embodiment (example of a band with a relatively wide width)
2. Second Embodiment (example of a band with a relatively narrow width)

1. First Embodiment

Configuration of Headphones

Figure 2:
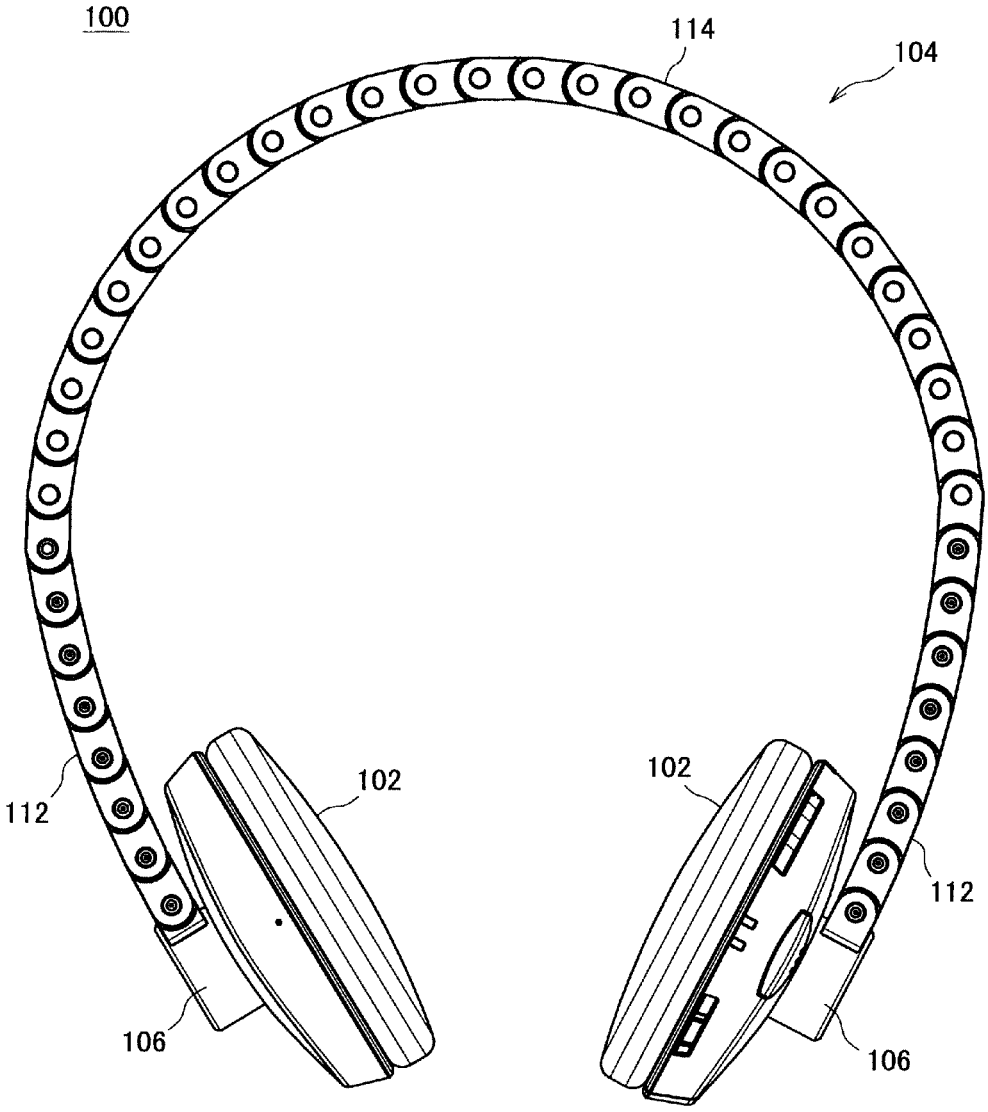
FIG. 2 is a front view showing the headphones 100 according to the first embodiment.
Figure 3:
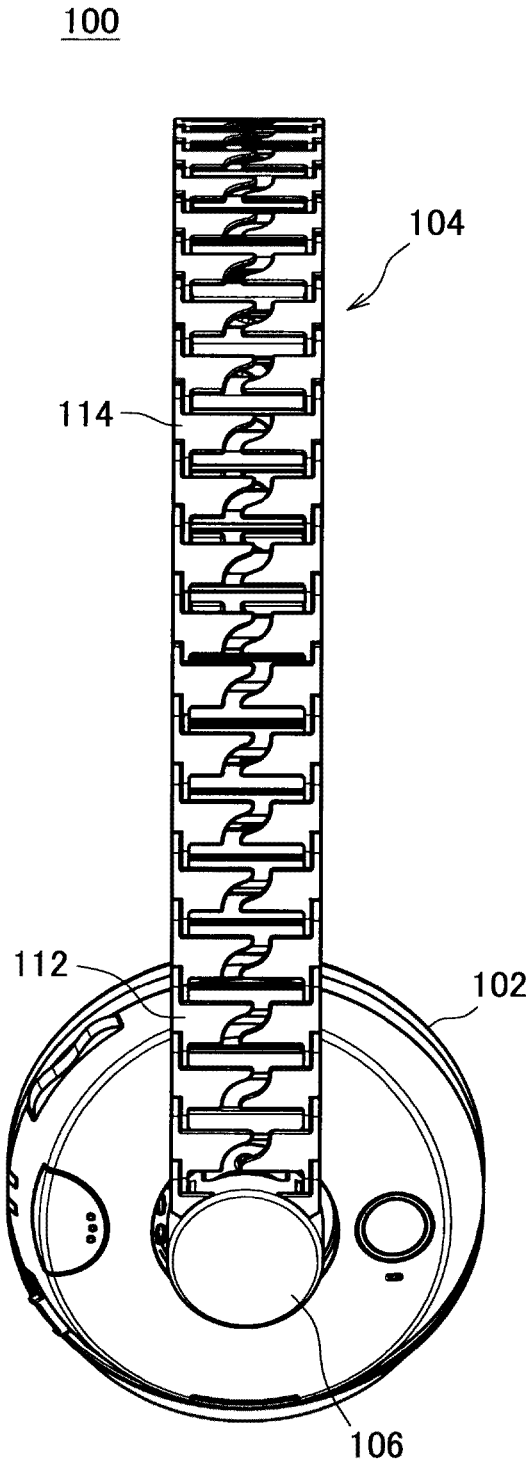
FIG. 3 is a right side view showing the headphones 100 according to the first embodiment.
Figure 4:
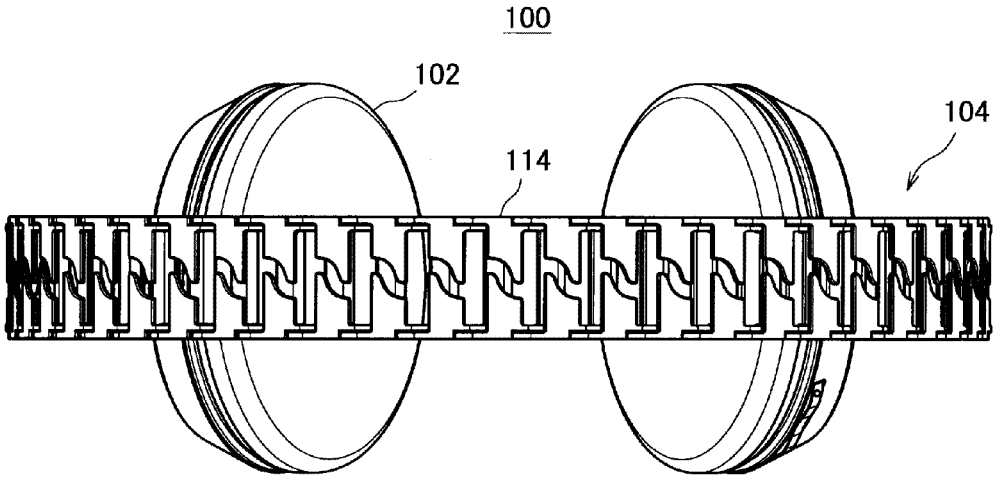
FIG. 4 is a top view showing the headphones 100 according to the first embodiment.

First, a configuration of headphones 100 according to a first embodiment of the present invention will be described with reference to FIGS. 1 to 4. FIG. 1 is a perspective view showing the headphones 100 according to the first embodiment of the present invention. FIG. 2 is a front view showing the headphones 100 according to the first embodiment. FIG. 3 is a right side view showing the headphones 100 according to the first embodiment. FIG. 4 is a top view showing the headphones 100 according to the first embodiment.

The headphones 100 include housings 102, a band 104, connecting members 106, and the like. The housings 102 of the headphones 100 shown in FIGS. 1 to 4 are earmuff type having a shape covering an entire auricle, and the band 104 is an example used as a headband.

The housing 102 is constituted by a case having a circular surface as shown in FIGS. 1 to 4. For example, the housing 102 has a circular shape having a diameter of about 10 cm. The connecting member 106 is provided on an external surface of the housing 102.

The housing 102 contains a speaker unit (not shown in the figures). For example, a reproduction signal is input into the speaker unit from a reproduction apparatus via a wireless connection, and the speaker unit outputs reproduced sound. In this case, a reproduction signal receiving section (not shown in the figures), a battery section (not shown in the figures), and the like are provided inside the housing 102. As the speaker unit, an ordinary speaker unit can be used, so that detailed description will be omitted.

The speaker unit and the reproduction apparatus may be connected to each other via wire. In this case, an electrical wire is provided in the housing 102, and a reproduction signal is input into the speaker unit from the reproduction apparatus via the electrical wire. An electrical wire 122 which transmits an electrical signal from the speaker unit or an electrical signal to the speaker unit is arranged inside the band 104. How to insert the electrical wire 122 inside the band 104 will be described below.

The band 104 is constituted by a series of links 112 and 114 connected to each other by a joint, and connected to the housings 102 at both ends via the connecting members 106. The link 112 is a member constituting a portion near a connection section to the housing 102, and the link 114 is a member constituting an intermediate portion of the band 104. Although the links 112 and the links 114 are rotatable around a joint between the links 112 and between the links 114, the links 112 and the links 114 include an angle limiter, and rotation angles between the links 112 and between the links 114 are limited.

Operation of Band 104 of Headphones 100

FIGS. 1 to 4 show a state of the headphones 100 when the headphones 100 are worn on a user's head, and the band 104 is opened outwardly. Here, the outward direction is an opposite direction to an inward direction when assuming that the user's head is positioned on the inward side of the band 104 when the user wears the headphones 100.

The rotation angles of the links 112 and 114 are limited so that the links 112 and 114 may not rotate outward more than a state shown in FIGS. 1 to 4. The links 112 and 114 of the band 104 are formed of an elastic material such as a synthetic resin (for example, polypropylene) or the like. As a result, when the headphones 100 are worn on a user's head, the band 104 has an elastic force in a direction in which the housing 102 presses auricles of the user.

In the band 104, the limited rotation angle of the links 112 near the connection section to the housing 102 may be different from the limited rotation angle of the links 114 of the intermediate portion of the band 104. For example, the rotation angle of the links 112 is limited to a position in which the series of links 112 become a near straight line. The rotation angle of the links 114 is limited to a position in which the series of links 114 has a circular shape with a diameter of about 20 cm. Based on this, when the band 104 is opened as shown in FIGS. 1 to 4, the shape of the band 104 can be formed so that the band 104 is placed along the circumference of the head.

Figure 5:
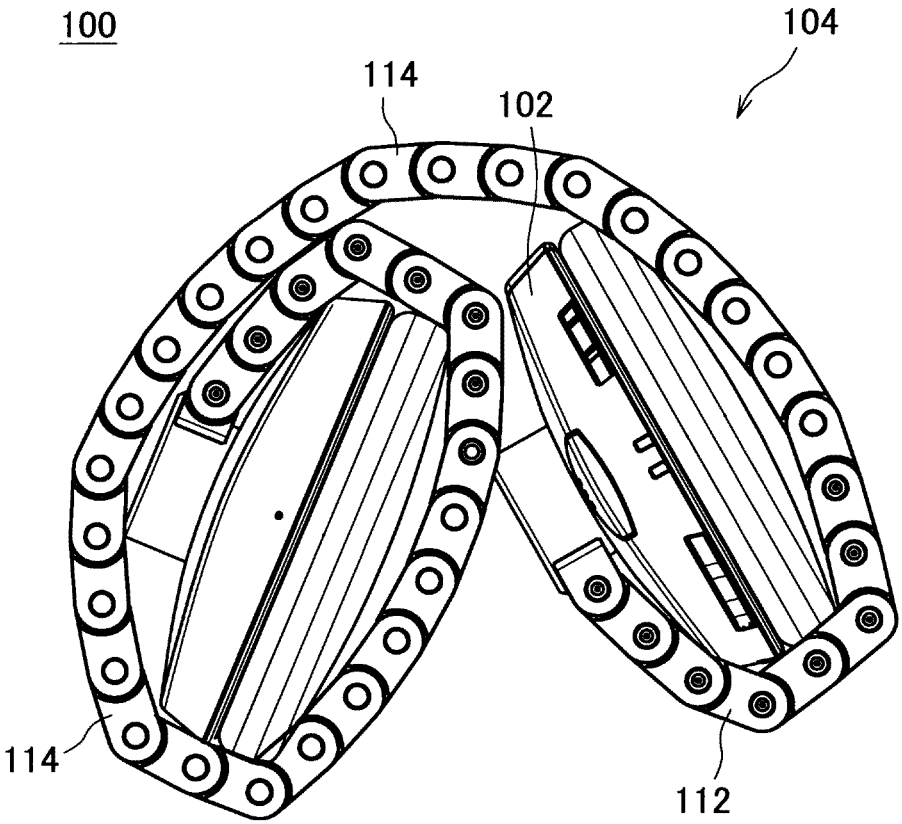
FIG. 5 is a front view showing a first state in which the headphones 100 according to the first embodiment are folded up.
Figure 6:
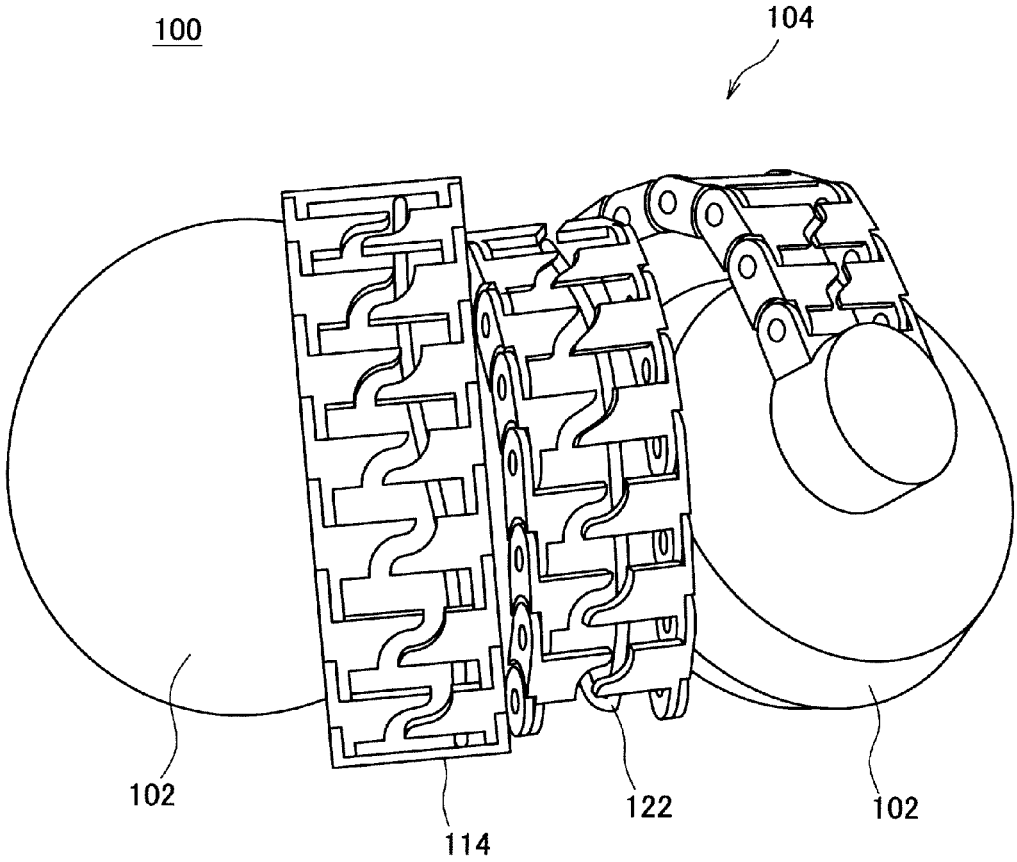
FIG. 6 is a front view showing a second state in which the headphones 100 according to the first embodiment are folded up.

While the state in which the headphones 100 are opened outwardly is described in FIGS. 1 to 4, next, a state in which the headphones 100 are folded up will be described with reference to FIGS. 5 and 6. FIG. 5 is a front view showing a first state in which the headphones 100 according to the first embodiment are folded up. FIG. 6 is a front view showing a second state in which the headphones 100 according to the first embodiment are folded up.

The links 112 and 114 are configured to have an inwardly rotatable angle range larger than an outwardly rotatable angle range. Therefore, the band 104 has a higher degree of freedom in rotation in the inward direction compared with a degree of freedom in rotation in the outward direction, so that the band 104 can be rolled up compactly by bending it inwardly. For example, as shown in FIG. 5, regarding the headphones 100, the band 104 can be helically rolled up on a plane surface so that the band 104 is placed into the same plane.

The links 112 and 114 are made of, for example, a synthetic resin. Therefore, the band 104 can not only be helically rolled up on a plane surface as shown in FIG. 5, but also, as shown in FIG. 6, can be easily rolled up so that the band 104 forms a helical shape from one end to the other end.

Since the band 104 of the headphones 100 according to the first embodiment is constituted by a plurality of links 112 and links 114 as described above, it is possible to realize a roll-up method which was not realized in the past, and the band 104 can be folded in a compact form, so that easy storage and carrying which were not realized in the past can be realized. The links 112 and 114 are simple components, and many links are connected to form the band 104, so that a complex component for a folding structure used in headphones in the past is not necessary.

Figure 7:
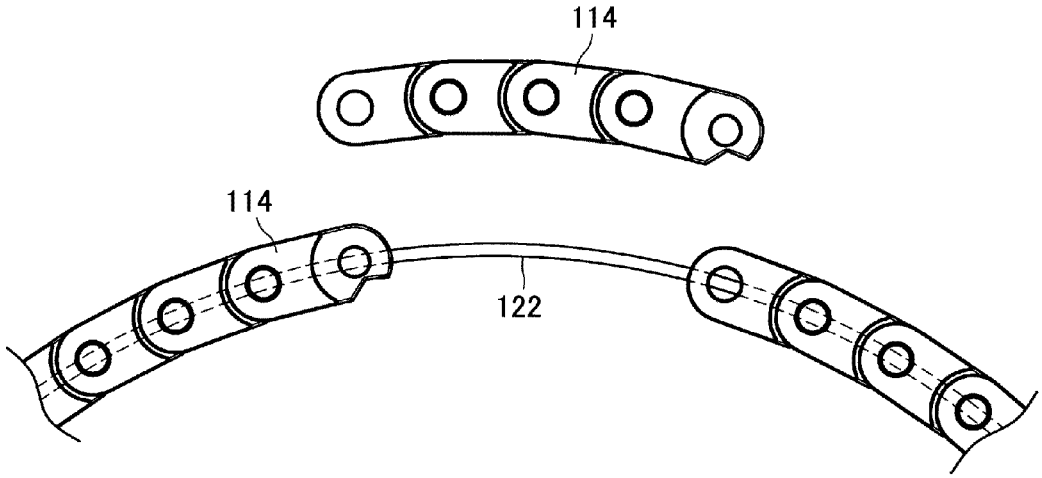
FIG. 7 is a front view showing a state in which links 114 of a band 104 is removed in the headphones 100 according to the first embodiment.

Next, adjustment of the length of the band 104 will be described with reference to FIG. 7. FIG. 7 is a front view showing a state in which the links 114 of the band 104 is removed in the headphones 100 according to the first embodiment.

The links 112 and 114 which constitute the band 104 of the headphones 100 are formed of an elastic material. Therefore, the links 112 and links 114 can be relatively easily connected to each other by a joint, and also disconnected from each other from a state of being connected to each other. The electrical wire 122 wired inside the band 104 can be passed through a first opening 136 provided in the links 112 and 114. Therefore, since each of the links 112 and the links 114 constituting the band 104 can be easily removed at joints, the length of the band 104 can be easily adjusted.

As shown in FIG. 7, one or a plurality of links 114 (or links 112 not shown in FIG. 7) can be removed from any portion of the band 104. The remaining links 114 (or links 112, or links 112 and links 114) are connected to each other. In this way, the length of the band 104 can be easily shortened.

On the contrary, it is possible to disconnect the connection between the links 114 at any position in the band 104, insert one or a plurality of links 114 between the disconnected links 114, and connect the links 114 again. In this way, the length of the band 104 can be easily extended.

In the past, to adjust the length of the band, it was necessary to use a complex structure, such as a structure in which a rail is used so that the band can slide, in the band. The components constituting the band were difficult to be disconnected from each other. On the other hand, according to the headphones 100 of the first embodiment, the length of the headband can be easily adjusted.

Link 114

Figure 8:
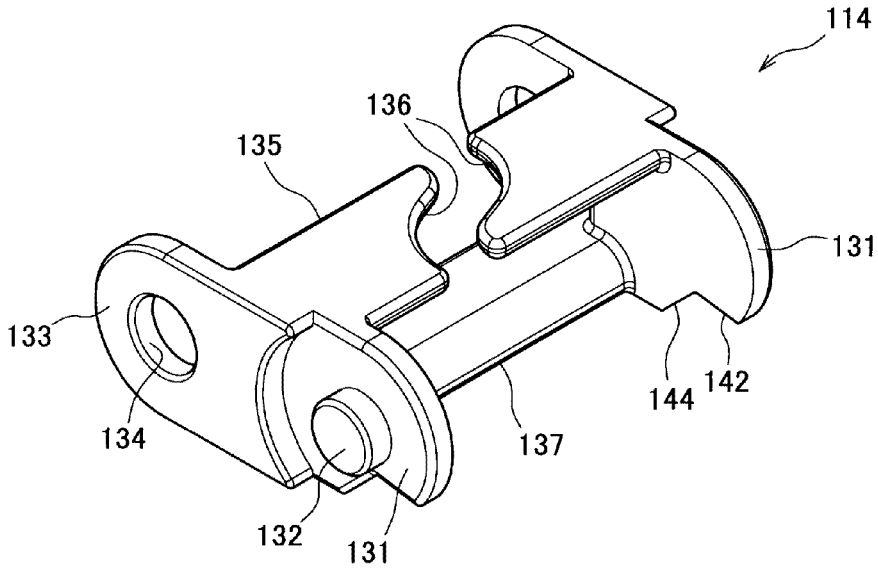
FIG. 8 is a perspective view showing the link 114 of the headphones 100 according to the first embodiment.
Figure 9A:
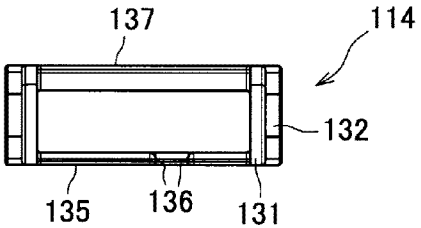
FIG. 9A is a rear view showing the link 114 of the headphones 100 according to the first embodiment.
Figure 9B:
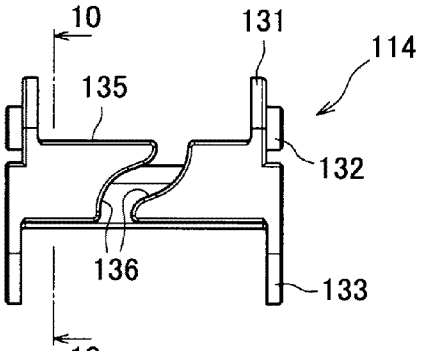
FIG. 9B is a plan view showing the link 114 of the headphones 100 according to the first embodiment.
Figure 9C:
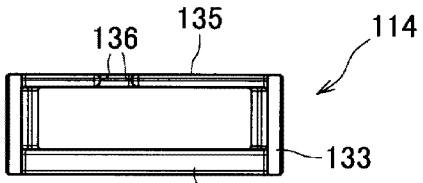
FIG. 9C is a front view showing the link 114 of the headphones 100 according to the first embodiment.
Figure 9D:
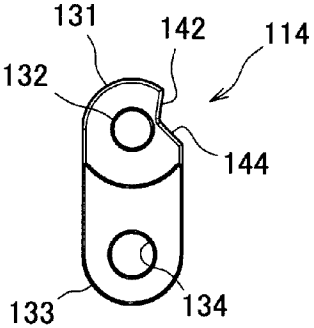
FIG. 9D is a right side view showing the link 114 of the headphones 100 according to the first embodiment.
Figure 9E:
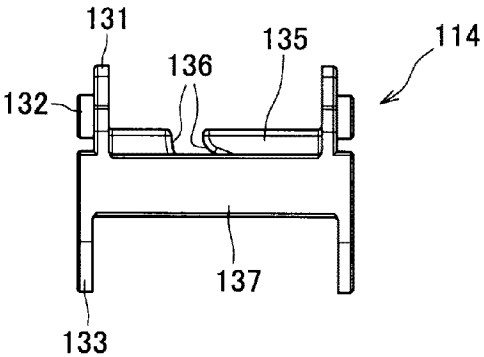
FIG. 9E is a bottom view showing the link 114 of the headphones 100 according to the first embodiment.
Figure 10:
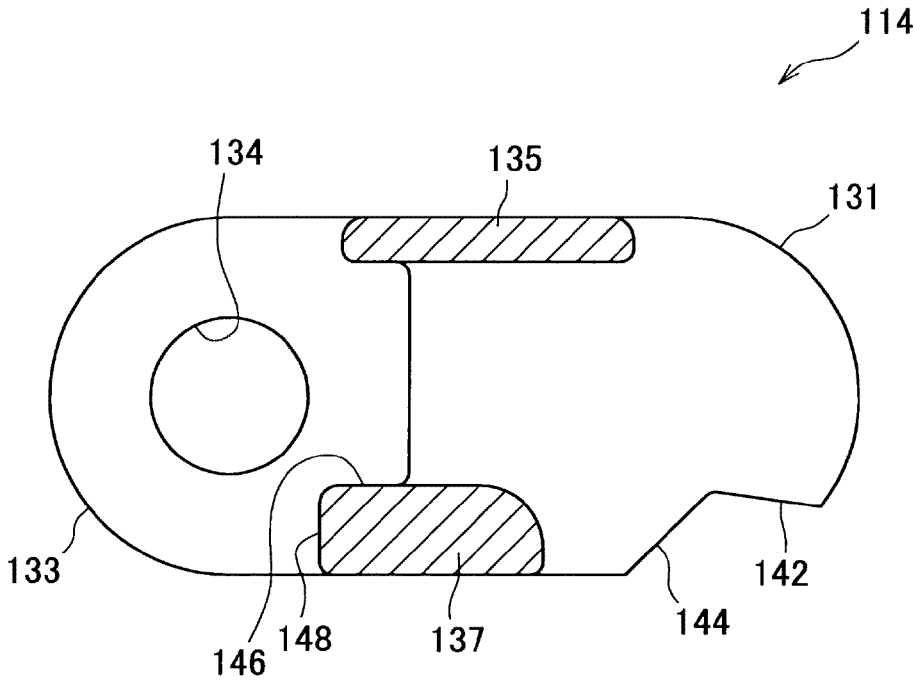
FIG. 10 is a cross-sectional view taken along line 10-10 in FIG. 9.

Next, the link 114 used in the band 104 according to the first embodiment will be described with reference to FIGS. 8 to 10. The links 114 are the members used in the intermediate portion of the band 104. FIG. 8 is a perspective view showing the link 114 of the headphones 100 according to the first embodiment. FIG. 9A is a rear view, FIG. 9B is a plan view, FIG. 9C is a front view, FIG. 9D is a right side view, and FIG. 9E is a bottom view showing the link 114 of the headphones 100 according to the first embodiment. FIG. 10 is a cross-sectional view taken along line 10-10 in FIG. 9.

The link 114 includes first side members 131, second side members 133, a first connecting member 135, and a second connecting member 137. The links 114 are the members which are connected to each other to constitute the band 104.

As shown in FIGS. 8 and 9, the first side member 131, the second side member 133, the first connecting member 135, and the second connecting member 137 are members having a flat plate shape.

The first side member 131 and the second side member 133 are adjacent to each other, and a surface in which the first side member 131 and the second side member 133 are combined together forms one side surface of the link 114. In one link 114, there are two side surfaces in which the first side member 131 and the second side member 133 are combined together, and the two side surfaces face each other. The external surface of the first side member 131 is located inward of the link 114 from the external surface of the second side member 133 by the thickness of the second side member 133. Based on this, when connecting a plurality of links 114 each other, the side surface of the band 104 is on the same level.

The first connecting member 135 connects each one edge (upper edge in FIG. 8) of the two side surfaces facing each other at both ends of the first connecting member 135. The second connecting member 137 connects the other edges (lower edges in FIG. 8) of the two side surfaces facing each other at both ends of the second connecting member 137. The external surface of first connecting member 135 and the external surface of the second connecting member 137 are in parallel with each other.

The first side member 131 includes a protruding portion 132. The protruding portion 132 has a cylindrical shape. The second side member 133 includes a second opening 134. The second opening 134 is an opening having a circular shape, and the protruding portion 132 of another link 114 can fit into the second opening 134. By fitting the protruding portion 132 into the second opening 134, the link 114 can rotate around an axis connecting two protruding portions 132 opposing each other (or an axis connecting two second openings 134 facing each other). The protruding portion 132 and the second opening 134 are an example of the joint of the link 114.

Further, the link 114 includes an angle limiter for limiting the rotation angle between the links 114. By limiting the rotation angle, the band 104 has an elastic force in the direction in which the housing 102 presses listener's auricles.

The angle limiter includes a first contact surface 142 and a second contact surface 144 formed on the first side member 131 and a third contact surface 146 and a fourth contact surface 148 formed on the second connecting member 137 as shown in FIG. 10. The first contact surface 142 and the second contact surface 144 are formed by cutting off a part of the first side member 131. The third contact surface 146 and the fourth contact surface 148 correspond to the upper surface and a side surface of the second connecting member 137.

When two links 114 are connected to each other, if a link 114 rotates in one direction, the first contact surface 142 comes into contact with the third contact surface 146 of an adjacent link 114. As a result, the rotation of the band 104 in the outward direction of the band 104 is limited. For example, in the link 114, the angle formed by the first contact surface 142 and the external surface of the first connecting member 135 is 8°, and the third contact surface 146 is in parallel with the external surface of the first connecting member 135. As a result, two links 114 adjacent to each other can rotate outwardly until the angle formed by the two links 114 reaches 8°. In this example, when a plurality of links 114 are rotated outwardly, if there are 45 (360°/8°) links 114, the links 114 forms a full round arc.

When two links 114 are connected to each other, if a link 114 rotates in the other direction opposite to the one direction described above, the second contact surface 144 comes into contact with the fourth contact surface 148 of an adjacent link 114. As a result, the rotation of the band 104 in the inward direction of the band 104 is limited. For example, in the link 114, the angle formed by the second contact surface 144 and the external surface of the first connecting member 135 is 45°, and the angle formed by the fourth contact surface 148 and the external surface of the first connecting member 135 is 90°. As a result, two links 114 adjacent to each other can rotate inwardly until the angle formed by the two links 114 reaches 45°. In this example, when a plurality of links 114 are rotated inwardly, if there are 8 (360°/45°) links 114, the links 114 forms a full round arc.

Further, a first opening 136 is formed in the first connecting member 135 of the link 114. The first opening 136 is an example of an opening. The first opening 136 is formed in the same direction as that in which a plurality of links 114 are connected to form the band 104. The first opening 136 of the headphones 100 according to the first embodiment shown in FIG. 1 or the like is formed in a diagonal direction but not in the direction in parallel with the direction in which the band 104 is formed, and further the first opening 136 has a wave shape. Since the opening is provided, the electrical wire 122 can be inserted into the inside of the band 104 through the first opening 136 in the longitudinal direction of the band 104. On the contrary, the electrical wire 122 can be removed from the inside of the band 104 to the outside through the first opening 136. Since the first opening 136 has the shape as shown in the figures, the electrical wire 122 does not easily fall out from the inside of the band 104 even when the band 104 is rolled up or opened outward.

Link 112

While the link 114 is described above, the link 112 also has the same configuration as that of the link 114 except for the angle limiter. In the band 104, the link 112 is arranged near the connection portion between the housing 102 and the band 104.

In the same way as in the link 114, the link 112 includes the first side member 131, the second side member 133, the first connecting member 135, and the second connecting member 137. The first side member 131 includes the protruding portion 132, and the second side member 133 includes the second opening 134.

Further, the link 112 includes an angle limiter for limiting the rotation angle between the links 112. The angle limiter includes the first contact surface 142 and the second contact surface 144 formed on the first side member 131, and the third contact surface 146 and the fourth contact surface 148 formed on the second connecting member 137.

The range of the rotation angle in which the link 112 can rotate is different from that of the link 114.

When two links 112 are connected to each other, if a link 112 rotates in one direction, the first contact surface 142 comes into contact with the third contact surface 146 of an adjacent link 112. As a result, the rotation of the band 104 in the outward direction of the band 104 is limited.

For example, although, in the link 114, the angle formed by the first contact surface 142 and the external surface of the first connecting member 135 is 8°, in the link 112, both the first contact surface 142 and the third contact surface 146 are in parallel with the external surface of the first connecting member 135. As a result, two links 112 adjacent to each other can limitedly rotate outwardly until the angle formed by the two links 112 reaches 0°, in other words, until the two links 112 are linearly aligned. Therefore, when the headphones 100 are worn by a listener, the links 112 are placed linearly along the head, so that the headphones 100 can be properly worn on the head.

Electrical Wire 122

Figure 17:
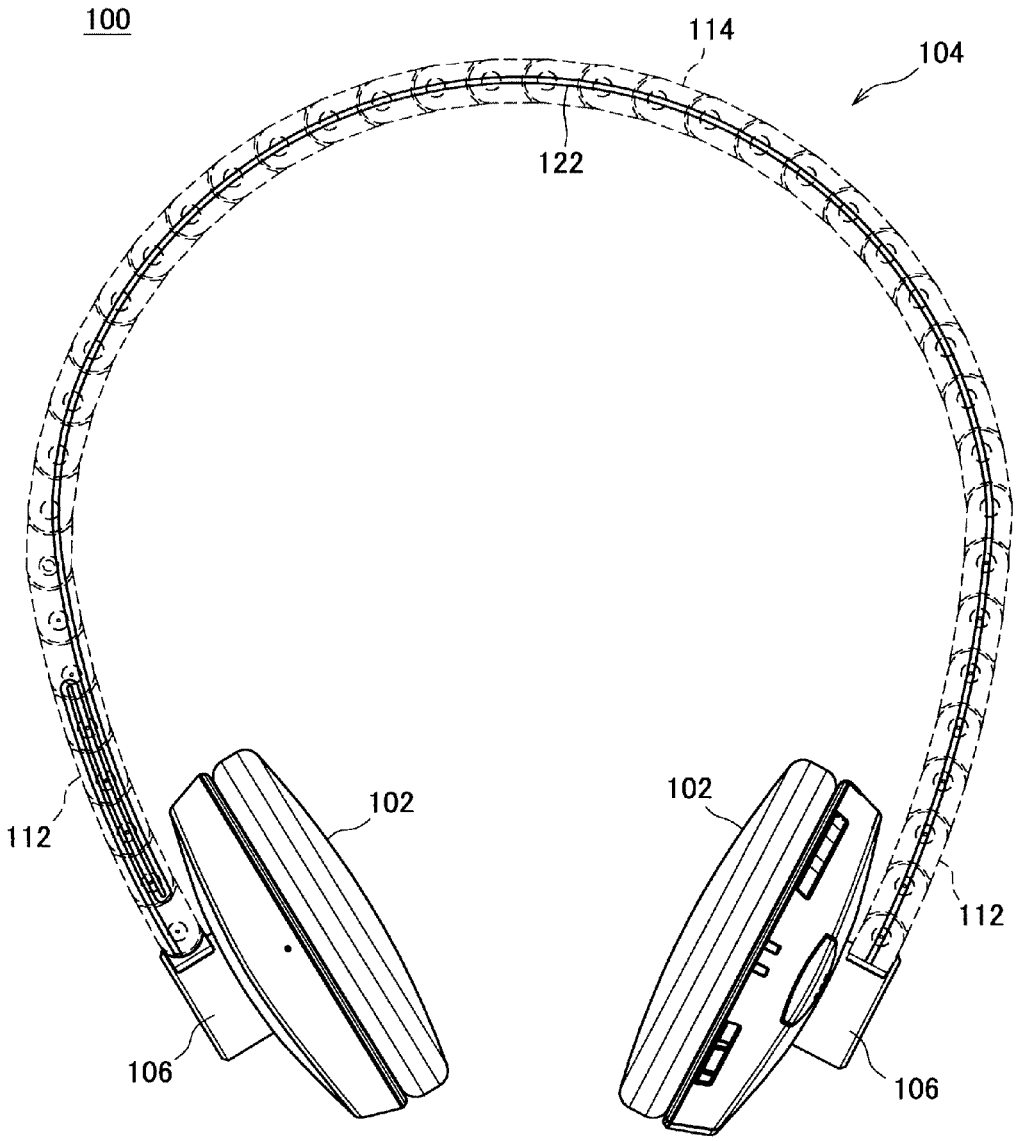
FIG. 17 is a front view showing headphones 100 according to the first embodiment of the present invention.
Figure 18:
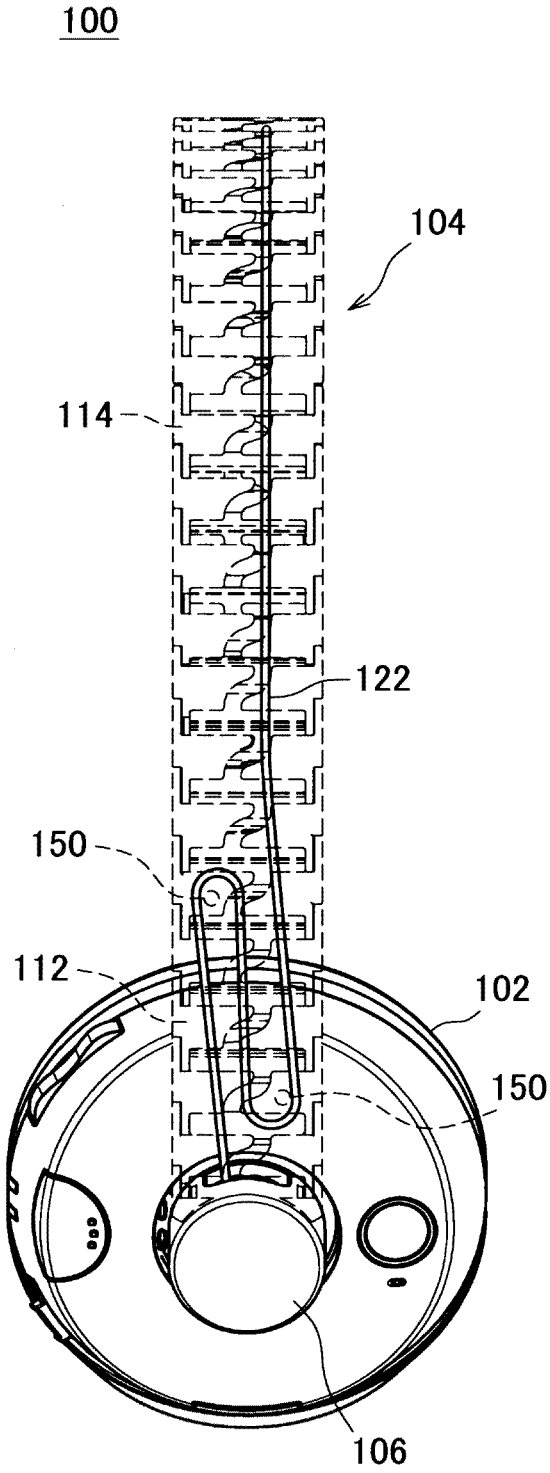
FIG. 18 is a right side view showing the headphones 100 according to the first embodiment.
Figure 19A:
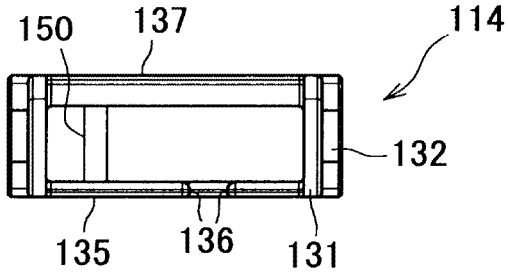
FIG. 19A is a rear view showing a modified example of the link 114 of the headphones 100 according to the first embodiment.
Figure 19B:
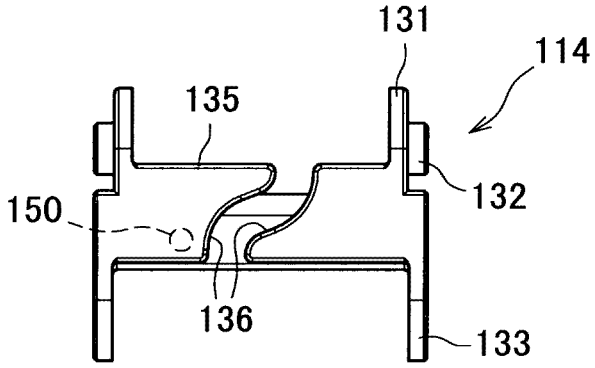
FIG. 19B is a plan view showing a modified example of the link 114 of the headphones 100 according to the first embodiment.
Figure 19C:
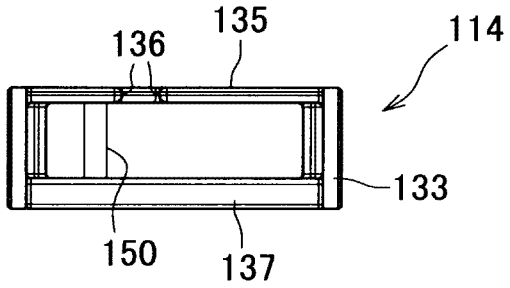
FIG. 19C is a front view showing a modified example of the link 114 of the headphones 100 according to the first embodiment.

Next, the electrical wire 122 wired inside the band 104 will be described with reference to FIGS. 17 to 19. FIG. 17 is a front view showing the headphones 100 according to the first embodiment of the present invention. FIG. 18 is a right side view showing the headphones 100 according to the first embodiment. FIG. 19A is a rear view, FIG. 19B is a plan view, and FIG. 19C is a front view showing a modified example of the link 114 of the headphones 100 according to the first embodiment.

In FIGS. 17 and 18, the electrical wire 122 wired inside the band 104 is shown by solid lines, and the links 112 and 114 constituting the band 104 are shown by dashed lines.

The electrical wire 122 is a conductive wire connecting the left and right speaker units. It is preferable that the electrical wire 122 is wired in S-shape inside the band 104. Based on this, when adjusting the length of the band 104 while shortening or lengthening the band 104 by removing the links 112 or the links 114 of the band 104, it is possible to make it easy to handle the electrical wire 122. The position where the S-shape of the electrical wire 122 is provided inside the band 104 and the length of the S-shaped portion are not limited to the position and the length shown in FIGS. 17 and 18.

When the electrical wire 122 is wired inside the band 104 in S-shape, as shown in FIGS. 18 and 19, fixing members 150 may be provided in the link 114 or the link 112. The fixing members 150 are located inside the S-shaped bends, and thus it is possible to prevent the electrical wire 122 from being erroneously pulled out excessively when adjusting the length of the band 104.

In an example shown in FIG. 19, the fixing member 150 is vertically provided on the inside surface of the first connecting member 135 and the second connecting member 137. The shape of the fixing member is not limited to this shape as long as the electrical wire 122 can be prevented from being pulled out.

Although not shown in the figures, the housing 102 may include a mechanism for rewinding the electrical wire 122 inside the housing 102. For example, when a button provided outside the housing 102 is pressed, the rewinding mechanism for the electrical wire 122 can accommodate the electrical wire 122 in the housing 102 while rewinding the electrical wire 122. On the other hand, when the electrical wire 122 is pulled by a hand of a user, the electrical wire 122 can be pulled out from the inside of the housing 102. In this way, when adjusting the length of the band 104, the length of the electrical wire 122 wired inside the band 104 can be appropriately adjusted.

2. Second Embodiment

Figure 11:
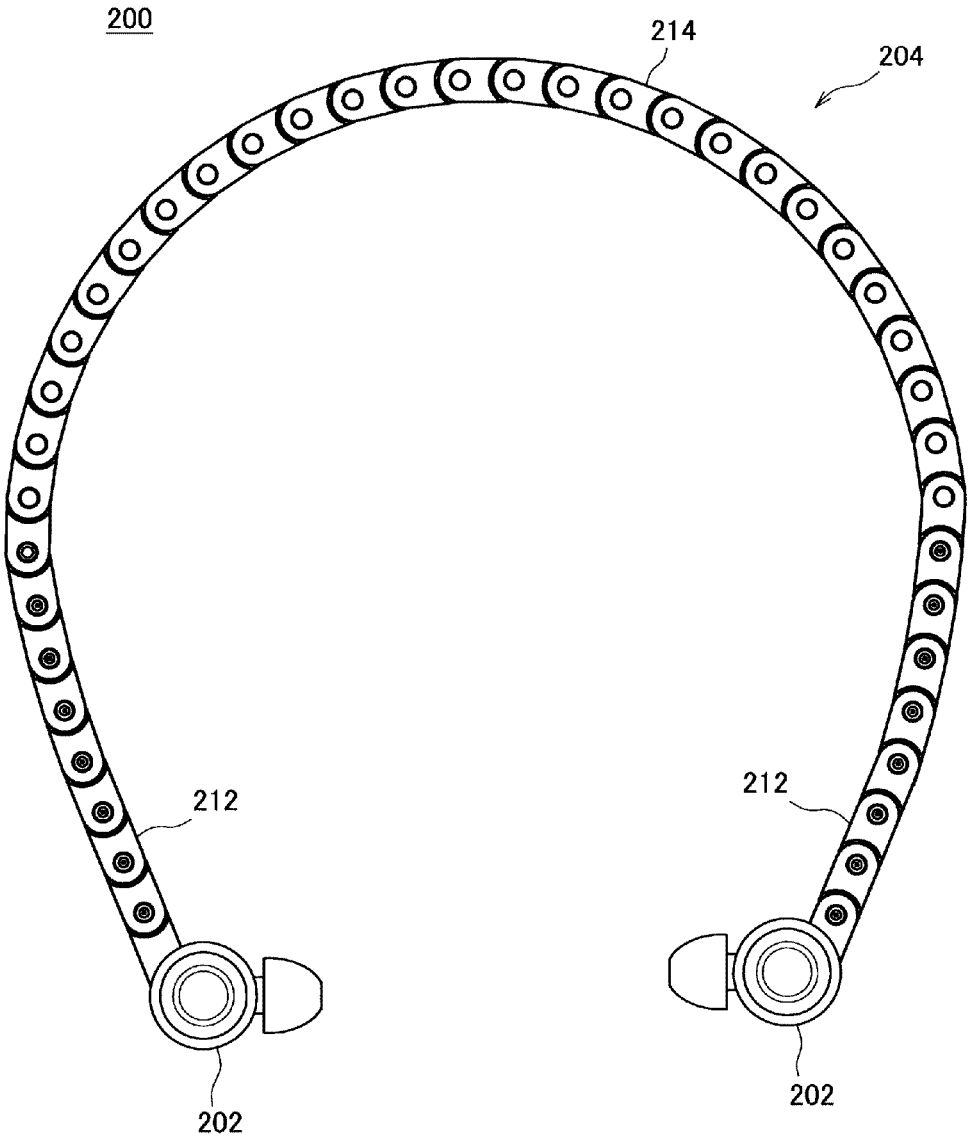
FIG. 11 is a front view showing headphones 200 according to a second embodiment of the present invention.
Figure 12:
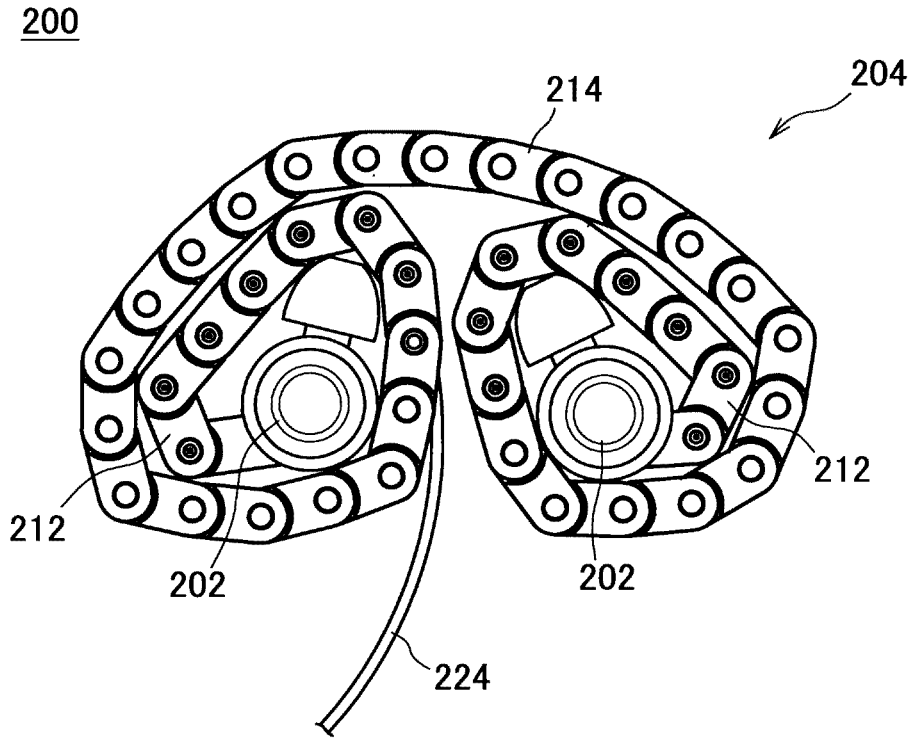
FIG. 12 is a front view showing a first state in which the headphones 200 according to the first embodiment are folded up.
Figure 13:
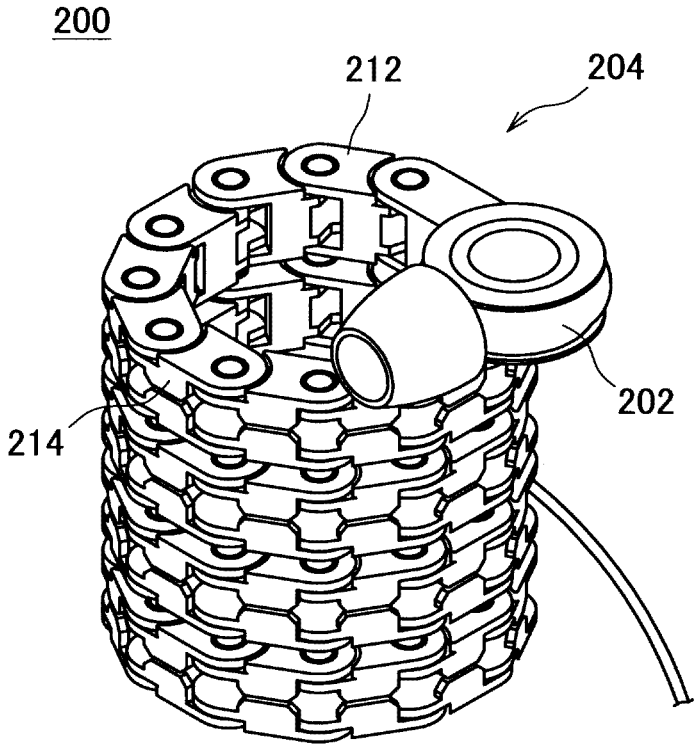
FIG. 13 is a front view showing a second state in which the headphones 200 according to the first embodiment are folded up.

Next, headphones 200 according to a second embodiment of the present invention will be described with reference to FIGS. 11 to 16. FIG. 11 is a front view showing the headphones 200 according to the second embodiment of the present invention. FIG. 12 is a front view showing a first state in which the headphones 200 according to the second embodiment are folded up. FIG. 13 is a perspective view showing a second state in which the headphones 200 according to the second embodiment are folded up.

Figure 14:
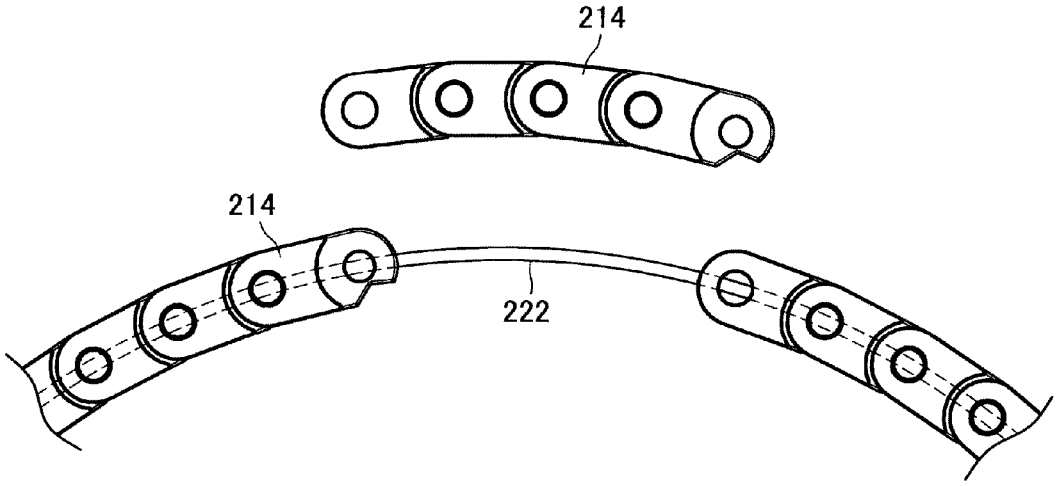
FIG. 14 is a front view showing a state in which links 214 of a band 202 is removed in the headphones 200 according to the second embodiment.
Figure 15:
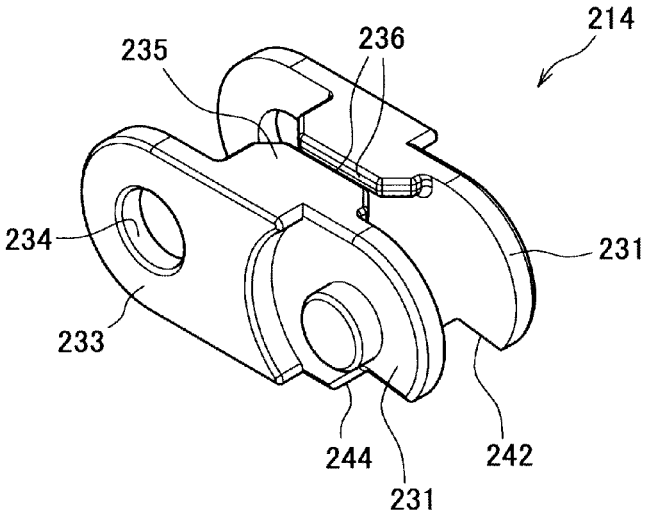
FIG. 15 is a perspective view showing the link 214 of the headphones 200 according to the second embodiment.
Figure 16A:
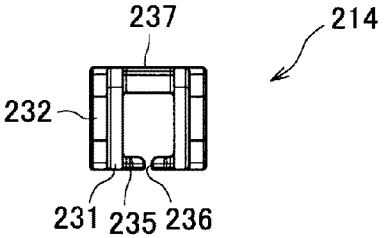
FIG. 16A is a rear view showing the link 214 of the headphones 200 according to the second embodiment.
Figure 16B:
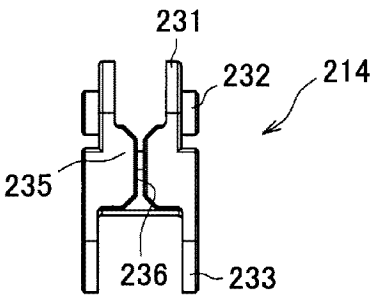
FIG. 16B is a plan view showing the link 214 of the headphones 200 according to the second embodiment.
Figure 16C:
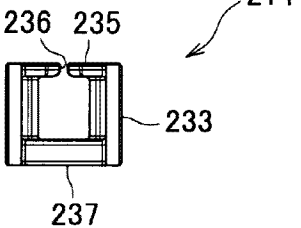
FIG. 16C is a front view showing the link 214 of the headphones 200 according to the second embodiment.
Figure 16D:
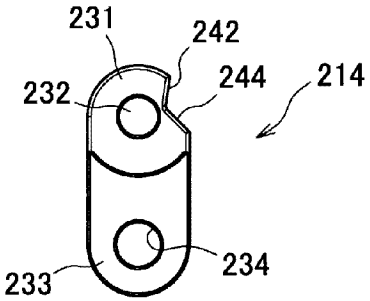
FIG. 16D is a right side view showing the link 214 of the headphones 200 according to the second embodiment.
Figure 16E:
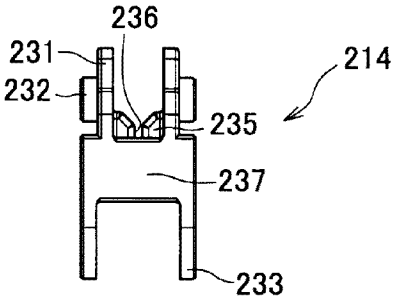
FIG. 16E is a bottom view showing the link 214 of the headphones 200 according to the second embodiment.

FIG. 14 is a front view showing a state in which links 214 of a band 204 is removed in the headphones 200 according to the second embodiment. FIG. 15 is a perspective view showing the link 214 of the headphones 200 according to the second embodiment. FIG. 16A is a rear view, FIG. 16B is a plan view, FIG. 16C is a front view, FIG. 16D is a right side view, and FIG. 16E is a bottom view showing the link 214 of the headphones 200 according to the second embodiment.

Configuration of Headphones 200

The headphones 200 include housings 202, the band 204, and the like.

Differently from the housings 102 according to the first embodiment, the housings 202 are insert type having a shape to be inserted into an ear canal and worn like earplugs. The band 204 is an example used as a headband or a neckband. By using such a combination, the headphones 200 which are difficult to be dislocated even when a user plays sport such as running can be realized. Speaker units in the housings 202 and a reproduction apparatus outside the headphones 200 may be connected to each other via wire. In this case, as shown in FIG. 12, an electrical wire 224 is provided to the headphones 200, and a reproduction signal is input into the speaker units from the reproduction apparatus via the electrical wire 224.

The band 204 is constituted by a series of links 212 and 214 connected to each other by a joint, and connected to the housings 202 at both ends. The link 212 is a member constituting a portion near a connection section to the housing 202, and the link 214 is a member constituting an intermediate portion of the band 204. Although the links 212 and the links 214 are rotatable around a joint between the links 212 and between the links 214, the links 212 and the links 214 include an angle limiter, and rotation angles between the links 212 and between the links 214 are limited.

Differently from the band 104 according to the first embodiment, the band 204 has a relatively narrow width perpendicular to the longitudinal direction. Because of this, the shape of a first opening 236 according to the second embodiment is different from the shape of the first opening 136 according to the first embodiment. However, the band 204 has almost the same configuration as that of the band 104 except the shape of the first opening 236.

Operation of Band 204 of Headphones 200

FIG. 11 shows a state of the headphones 200 when the headphones 200 are worn on a user's head, and the band 204 is opened outwardly.

The rotation angles of the links 212 and 214 are limited so that the links 212 and 214 may not rotate outward more than a state shown in FIG. 11. The links 212 and 214 of the band 204 are formed of an elastic material such as a synthetic resin (for example, polypropylene) or the like. As a result, when the headphones 200 are worn on a user's head, the band 204 has an elastic force in a direction in which the housing 202 presses auricles of the user.

In the band 204, the limited rotation angle of the links 212 near the connection section to the housing 202 may be different from the limited rotation angle of the links 214 of the intermediate portion of the band 204. For example, the rotation angle of the links 212 is limited to a position in which the series of links 212 become a near straight line. The rotation angle of the links 214 is limited to a position in which the series of links 214 has a circular shape with a diameter of about 20 cm. Based on this, when the band 204 is opened as shown in FIG. 11, the shape of the band 204 can be formed so that the band 204 is placed along the circumference of the head.

Next, a state in which the headphones 200 are folded up will be described.

The links 212 and 214 are configured to have an inwardly rotatable angle range larger than an outwardly rotatable angle range. Therefore, the band 204 has a higher degree of freedom in rotation in the inward direction compared with a degree of freedom in rotation in the outward direction, so that the band 204 can be rolled up compactly by bending it inwardly. For example, as shown in FIG. 12, regarding the headphones 200, the band 204 can be helically rolled up on a plane surface so that the band 204 is placed into the same plane.

The links 212 and 214 are made of, for example, a synthetic resin. Therefore, the band 204 of the headphones 200 can not only be helically rolled up on a plane surface as shown in FIG. 12, but also, as shown in FIG. 13, can be rolled up so that the band 204 forms a helical shape from one end to the other end. Although the band 204 rolled up helically as shown in FIG. 13 has a shape different from the shape of the band 104 rolled up helically according to the first embodiment shown in FIG. 6, this is caused by the length and the width of the band 204 itself, the size of the housing 202, and the like.

Since the band 204 of the headphones 200 according to the second embodiment is constituted by a plurality of links 212 and links 214 as described above, it is possible to realize a roll-up method which was not realized in the past, and the band 204 can be folded in a compact form, so that easy storage and carrying which were not realized in the past can be realized. The links 212 and 214 are simple components, and many links are connected to form the band 204, so that a complex component for a folding structure used in headphones in the past is not necessary.

As shown in FIG. 14, the length of the band 204 can be adjusted in the same way as the band 104 according to the first embodiment. The links 212 and 214 which constitute the band 204 of the headphones 200 are formed of an elastic material. Therefore, the links 212 and links 214 can be relatively easily connected to each other by a joint, and also disconnected from each other from a state of being connected to each other. The electrical wire 222 wired inside the band 204 can be passed through the first opening 236 provided in the links 212 and 214. Therefore, since each of the links 212 and the links 214 constituting the band 204 can be easily removed at joints, the length of the band 204 can be easily adjusted.

As shown in FIG. 14, one or a plurality of links 214 (or links 212 not shown in FIG. 14) can be removed from any portion of the band 204. The remaining links 214 (or links 212, or links 212 and links 214) are connected to each other. In this way, the length of the band 204 can be easily shortened.

On the contrary, it is possible to disconnect the connection between the links 214 at any position in the band 204, insert one or a plurality of links 214 between the disconnected links 214, and connect the links 214 again. In this way, the length of the band 204 can be easily extended. According to the headphones 200 of the second embodiment, the length of the headband can be easily adjusted.

Link 214

Next, the link 214 used in the band 204 according to the second embodiment will be described with reference to FIGS. 15 and 16. The link 214 is a link used in the intermediate portion of the band 204.

The link 214 includes first side members 231, second side members 233, a first connecting member 235, and a second connecting member 237. The links 214 are the members which are connected to each other to constitute the band 204.

The first side member 231, the second side members 233, the first connecting member 235, and the second connecting member 237 respectively correspond to the first side member 131, the second side member 133, the first connecting member 135, and the second connecting member 137 according to the first embodiment. Detailed description of each member will be omitted.

The first side member 231 includes a protruding portion 232. The protruding portion 232 has a cylindrical shape. The second side member 233 includes a second opening 234. The second opening 234 is an opening having a circular shape, and the protruding portion 232 of another link 214 can fit into the second opening 234. By fitting the protruding portion 232 into the second opening 234, the link 214 can rotate around an axis connecting two protruding portions 232 opposing each other (or an axis connecting two second openings 234 facing each other). The protruding portion 232 and the second opening 234 are an example of the joint of the link 214.

Further, the link 214 includes an angle limiter for limiting the rotation angle between the links 214. By limiting the rotation angle, the band 204 has an elastic force in the direction in which the housing 202 presses listener's auricles.

The angle limiter includes the first contact surface 242 and the second contact surface 244 formed on the first side member 231, and the third contact surface 246 and the fourth contact surface 248 formed on the second connecting member 237. The first contact surface 242 and the second contact surface 244 are formed by cutting off a part of the first side member 231. The third contact surface 246 and the fourth contact surface 248 correspond to the upper surface and a side surface of the second connecting member 237.

Since a configuration and operation of the angle limiter according to the second embodiment are the same as those of the angle limiter described in the first embodiment, the detailed description will be omitted.

Further, the first opening 236 is formed in the first connecting member 235 of the link 214. The first opening 236 is an example of an opening. The first opening 236 is formed in the same direction as that in which a plurality of links 214 are connected to form the band 204. The first opening 236 of the headphones 200 according to the second embodiment shown in FIGS. 13, 15, and 16 is formed in a direction parallel with the direction in which the band 204 is formed, and further has a shape in which a part thereof is narrowed. Since the opening is provided, the electrical wire 222 can be inserted into the inside of the band 204 through the first opening 236 in the longitudinal direction of the band 204. On the contrary, the electrical wire 222 can be removed from the inside of the band 204 to the outside through the first opening 236. Since the first opening 236 has the shape in which a part thereof is narrowed as shown in the figures, the electrical wire 222 does not easily fall out from the inside of the band 204 even when the band 204 is rolled up or opened outward.

Link 212

While the link 214 is described above, the link 212 also has the same configuration as that of the link 114 except for the angle limiter. In the band 204, the link 212 is arranged near the connection portion between the housing 202 and the band 204. The range of the rotation angle in which the link 212 can rotate is different from that of the link 214.

Two links 212 adjacent to each other can rotate outwardly until the angle formed by the two links 212 reaches 0°, in other words, until the two links 212 are linearly aligned. Therefore, when the headphones 200 are worn by a listener, the links 212 are placed linearly along the head, so that the headphones 200 can be properly worn on the head.

According to the headphones 100 and 200 of the first and the second embodiments, it is possible to realize a roll-up method for the bands 104 and 204 which is not realized by headphones in related art. Since the bands 104 and 204 can be rolled up helically, it is possible to implement the headphones 100 and 200 that can be stored and carried in a manner which is not realized in the related art. In addition, since many simple components, such as the links 112, 114, 212, and 214, are connected to form the bands 104 and 204, a complex folding structure in the related art need not be used. Furthermore, since each of the links 112, 114, 212, and 214 constituting the bands 104 and 204 can be easily removed, the length of the bands can be adjusted, so that high customizability is realized.

It should be understood by those skilled in the art that various modifications, combinations, sub-combinations and alterations may occur depending on design requirements and other factors insofar as they are within the scope of the appended claims or the equivalents thereof.

For example, the shapes of the bands 104 and 204 are not limited to the examples described above. For example, the appearances of the links 112, 114, 212, and 214 may have more rounded shapes compared to the examples shown in the figures. Based on this, a rounded band can be formed. A cover such as a cloth may be put on the circumference of the bands 104 and 204. In this way, the appearance of the bands can be changed, and it is possible to prevent the listener's hair from being pinched between the links 112, 114, 212, and 214.

Further, although the case is described in which only one band 104 (or band 204) is provided between the two housings 102 (or 202), the present invention is not limited to this case. For example, two or more bands 104 (or 204) may be provided between the two housings 102 (or 202).

The links 112, 114, 212, and 214 may be configured so that each of the links 112, 114, 212, and 214 constituting the bands 104 and 204 can be removed and connected by an individual user, or may be configured so that each of the links 112, 114, 212, and 214 can be removed and connected only in factory before shipment. For example, the above can be realized by the shape and material of the links 112, 114, 212, and 214. In order not to release the S-shaped wiring of the electrical wire 122 described in the first embodiment, the links 112, 114, 212, and 214 only in the S-shaped wiring portion may be configured not to be removed by a user.

The number of the links 112, 114, 212, and 214 constituting the bands 104 and 204 is not limited to the examples described above. By using five or more links 112, 114, 212, and 214 constituting the bands 104 and 204, the length of the links 112, 114, 212, and 214 can be shortened, so that customizability in adjusting the length of the bands 104 and 204 can be secured. On the other hand, when four or less links 112, 114, 212, and 214 constituting the bands 104 and 204 are used, the length is difficult to be adjusted, so that it is necessary to provide an additional length adjustment mechanism. When ten or more links 112, 114, 212, and 214 constituting the bands 104 and 204 are used, the customizability in adjusting the length further increases, and compactness when the bands 104 and 204 are folded up improves.

Although the lengths of the links 112, 114, 212, and 214 constituting the bands 104 and 204 are the same in the examples described above, the present invention is not limited to the examples. For example, links with a long length and links with a short length may be mixed and connected in one band. Although, in the above examples, the case is described in which two types of links are combined so that two types of rotation angle limitations can be obtained in one band, the present invention is not limited to the examples. For example, it is possible to combine three or more types of links so that three or more types of rotation angle limitations are performed in one band.

Although the examples are described in which the housing 102 is earmuff type and the housing 202 is insert type, the present invention is not limited to the examples. For example, the housing may be on-ear type, intra-concha type, and the like.

The present application contains subject matter related to that disclosed in Japanese Priority Patent Application JP 2009/158154, filed in the Japan Patent Office on Jul. 2, 2009, the entire content of which is hereby incorporated by reference.

What is claimed is:

1. A headphone device comprising:

a housing comprising a speaker unit; and a band formed of a series of links and connected to the housing at an end of the band, each link of the series of links being connected to at least one other link by a joint, wherein the each link of the series of links comprises:

an angle limiter for limiting a rotation angle between the each link and an adjacent link, a cylindrical protrusion and a circular opening, wherein the cylindrical protrusion of the each link is adapted to fit into another circular opening of the adjacent link to connect the each link and the adjacent link, wherein the band has an elastic force in a direction in which the housing presses an auricle by limiting the rotation angle, and wherein at least one link of the series of links can be attached to or detached from the series of links at a first joint and a second joint, wherein the first joint connects to a first link of the series of links and the second joint connects to a second link of the series of links, the first link and the second link configured to be connected to each other when the at least one link is detached from the series of links.

2. The headphone device according to claim 1, wherein a first limited rotation angle for a portion of the band near a connection to the housing is different from a second limited rotation angle for a portion of the band in a middle of the band.

3. The headphone device according to claim 1, wherein the band is configured to be rolled up into a helical shape.

4. The headphone device according to claim 1, wherein the band comprises an elastic material.

5. The headphone device according to claim 1, wherein each link has an opening, and wherein an electrical wire for transmitting an electrical signal from or to the speaker unit can be inserted into an inside of the band through the opening or removed from the inside to an outside of the band through the opening.

6. The headphone device of claim 1, wherein at least one link of the series of links is configured to be removable and remaining links of the series of links are configured to be connected to each other.

7. The headphone device of claim 1, wherein the band is configured to be rolled up into a helical shape, wherein the helical shape is a three-dimensional helical shape.

8. The headphone device of claim 1, wherein the band is configured to be rolled up into a helical shape, wherein the helical shape is a planar helical shape configured to be substantially in a plane surface.

9. The headphone device of claim 1, wherein each link has an opening, wherein the opening is configured such that an electrical wire, when inserted into an inside of the band through the opening, is aligned along a longitudinal direction of the band.

* * * * *